US006838827B2

(12) United States Patent
Terao et al.

(10) Patent No.: US 6,838,827 B2
(45) Date of Patent: Jan. 4, 2005

(54) PLASMA DISPLAY INCLUDING CERTAIN LAYERS BEING USABLE AS HIGH-DEFINITION LARGE-SIZED DISPLAY AND METHOD FOR FABRICATING THE SAME

(75) Inventors: Yoshitaka Terao, Yokohama (JP); Takashi Komatsu, Yokohama (JP); Je-Hwan Oh, Seongnam (KR); Yukika Yamada, Yokohama (JP)

(73) Assignee: Samsung SDI, Co., Ltd., Suwon-si (KR)

( * ) Notice: Subject to any disclaimer, the term of this patent is extended or adjusted under 35 U.S.C. 154(b) by 203 days.

(21) Appl. No.: 09/984,630

(22) Filed: Oct. 30, 2001

(65) Prior Publication Data

US 2002/0070664 A1 Jun. 13, 2002

(30) Foreign Application Priority Data

Nov. 2, 2000 (JP) ..... 2000-336131

(51) Int. Cl.[7] ..... H01J 17/49

(52) U.S. Cl. ..... 313/583; 313/582; 313/586; 313/587; 313/609; 313/610; 445/24

(58) Field of Search ..... 313/582–583, 313/586, 587, 292, 495, 609–610; 445/24

(56) References Cited

U.S. PATENT DOCUMENTS 5,989,089 A * 11/1999 Ichiyoshi et al. ..... 445/24
6,149,482 A * 11/2000 Sakasegawa et al. ..... 445/24
6,184,621 B1 * 2/2001 Horiuchi et al. ..... 313/586
6,623,325 B2 * 9/2003 Tsuruoka et al. ..... 445/24

FOREIGN PATENT DOCUMENTS

JP 8-212918 8/1996
JP 10188791 A * 7/1998 ..... H01J/9/02
JP 10302616 A * 11/1998 ..... H01J/9/02
JP 2001042504 A * 2/2001 ..... G03F/1/08

* cited by examiner

*Primary Examiner*—Vip Patel
*Assistant Examiner*—Anthony Perry
(74) *Attorney, Agent, or Firm*—Robert E. Bushnell, Esq.

(57) ABSTRACT

A plasma display includes first and second transparent substrates disposed facing each other, a plurality of partitions formed between the first and second transparent substrates, a phosphor formed on inner surfaces of discharge cells defined by the partitions, a stepped buffering layer formed on the first transparent substrate between a one-end portions of the partitions, and a plurality of address electrodes formed on the first transparent substrate between the partitions and on the stepped buffering layer. A thickness of the stepped buffering layer is gradually increased in a longitudinal direction of the partition.

20 Claims, 5 Drawing Sheets

PLASMA DISPLAY INCLUDING CERTAIN LAYERS BEING USABLE AS HIGH-DEFINITION LARGE-SIZED DISPLAY AND METHOD FOR FABRICATING THE SAME

CLAIM OF PRIORITY

This application makes reference to, incorporates the same herein, and claims all benefits accruing under 35 U.S.C. §119 from an application entitled Plasma Display and Method for Fabricating the Same earlier filed in the Japan Patent Office on 2 Nov. 2000, and there duly assigned Serial No. 2000-336131 by that Office.

BACKGROUND OF THE INVENTION

1. Field of the Invention

The present invention relates to a plasma display and a method for fabricating the plasma display and, more particularly, to a plasma that is appropriate as a high-definition large-sized display.

2. Description of the Related Art

An earlier plasma display, as seen in FIG. 6, is designed for an AC-type (Alternating Current). The plasma display includes front and rear glass substrates 1 and 2 that are disposed facing each other. On an inner surface of the front glass substrate 1, a plurality of transparent line electrodes 3 are arranged in parallel. The electrodes 3 are covered with a dielectric layer 4 on which a transparent protecting layer 5 is formed. Disposed on an inner surface of the rear glass substrate 2 at right angles with respect to the plural transparent line electrodes 3 are a plurality of address line electrodes 6 covered with a dielectric layer 7 having a high reflection ratio. A plurality of straight partitions 8 are disposed in parallel on the dielectric layer 7 between the address line electrodes 6. Discharge cells 9 defining discharge spaces are defined by the partitions 8. Red R, green G and blue B phosphors 10 are formed on each inner surface of the discharge cells 9.

The front and rear glass substrates 1 and 2 are sealed by sealant after mixture gas such as Ne—Xe and He—Xe that use Xe-resonance discharge light of 147 nm (nanometers) is injected into each of the discharge cells 9.

In the above-described plasma display, the transparent line electrodes 3 and the address line electrodes 6 are extended out of the substrates 1 and 2 and connected to terminals. By selectively applying electric voltage, discharge is selectively generated in the discharge cells 9 between the electrodes 3 and 6, thereby exciting the phosphors 10 so that the light is emitted out of the substrates 1 and 2. At this point, the exciting surface becomes the surface of the phosphors 10 facing the discharge cells 9.

In addition, the partitions 8 are formed according to the following process.

First, the address line electrodes 6 are formed and baked on the inner surface of the rear glass substrate 2 through a printing process, and then the dielectric layer 7 is deposited on the inner surface while covering the electrodes 6. The partition layer is deposited on the dielectric layer 7 and a dry film resist pattern is deposited on the partition layer 8. The partition layer, which is not covered by the dry film resist pattern, is removed through a sand blast process, thereby forming the partitions 8.

That is, glass or calcium carbide particles each having a diameter of about 20–30 $\mu$m (micrometers) are sprayed by a nozzle to etch the partition layer on which the dry film resist pattern is not formed.

After the partition layer is removed, although the dielectric layer 7 is exposed, since the dielectric layer 7 is baked and hardened, it is not etched.

As described above, as the deposition and baking processes are repeatedly performed on the glass substrate to manufacture the plasma display, the glass substrate may be deformed by the heat generated in the baking process. Therefore, it has been required to reduce the baking temperature or the number of baking process to improve the productivity.

To meet the above requirement, Japanese Patent Publication No. H8-212918 discloses a method for forming the partitions by directly etching the glass substrate. As the partitions are formed by etching the glass substrate, there is no need of performing the baking process.

As shown in FIGS. 7 and 8, however, since the partitions are first formed before the address line electrodes 6 are formed, it is difficult to form the address line electrodes 6 between the partitions.

For example, since there is a gap of about 150 $\mu$m between one-end of the partition 8*a* and the glass substrate, the layer thickness of the electrode paste is increased. Accordingly, the electrode pattern may be short-circuited.

The height and pitch of the partition 8 are respectively about 150 $\mu$m and 360 $\mu$m. Under the current screen printing technology, it is difficult to print the address pattern having a width of about 50 $\mu$m on the bottom between the partitions 8 as it is difficult to approach the bottom.

Therefore, there is the transcription method for transferring the electrode paste on the bottom between the partitions 8. However, this method has a problem of alignment. That is, the paste may not be transferred on the desired location.

Accordingly, photosensitivity printing electrode paste such as FODEL Ag (produced by DUPONT) is first printed on the surface, and a developing process is performed to obtain a desired address line electrode pattern 6. However, this method has also a problem.

That is, the layer thickness of the electrode paste printed on a longitudinal end portion of the partition 8 is higher by more than 2–3 times that of other portions of the partition 8. This causes the margin for the developing process to be eliminated. Namely, when the developing process is performed for the thin layer, the thick layer is not patterned, and when performed for the thick layer, the thin layer is removed from the glass substrate.

SUMMARY OF THE INVENTION

It is therefore an objective of the present invention to provide a plasma display that has a planar electrode having a uniform layer thickness and a method for fabricating such a plasma display.

To achieve the above and other objectives, the present invention provides a plasma display including first and second transparent substrates disposed facing each other, a plurality of partition formed between the first and second transparent substrates, a phosphor formed on inner surfaces of discharge cells defined by the partitions, a stepped buffering layer formed on the first transparent substrate between one-end portions of the partitions, and a plurality of address electrodes formed on the first transparent substrate between the partitions and on the stepped buffering layer.

Preferably, a thickness of the stepped buffering layer is gradually increased in a longitudinal direction of the partition.

According to another aspect, the present invention provides a plasma display including first and second transparent substrates disposed facing each other, a plurality of partition formed between the first and second transparent substrates, a phosphor formed on inner surfaces of discharge cells defined by the partitions, and a stepped buffering layer formed on the first transparent substrate between one-end portions of the partitions, where a height of the one-end portion of each of the partition is gradually reduced in a longitudinal direction.

Preferably, the one-end portion is formed having a plurality of steps and a width of the one-end portion is reduced in the longitudinal direction.

According to another aspect, the present invention provides a plasma display including first and second transparent substrates disposed facing each other, a plurality of partitions formed between the first and second transparent substrates, and a phosphor formed on inner surfaces of discharge cells defined by the partitions, where one-end portion of each of the partitions becomes thinner as it goes in a longitudinal direction.

According to still another aspect, the present invention provides a method for fabricating a plasma display, including the steps of forming grooves on a transparent substrate between partitions to be formed, forming a stepped buffering layer on a portion of the groove corresponding to a one-end portion of each of the partition, and forming a plurality of address electrode on the grooves as well as on the stepped buffering layer.

Preferably, the step of forming the grooves may further include the steps of attaching a dry film resist having an endurance sandblast property on the transparent substrate, exposing the dry film resist on light in a predetermined pattern and developing the dry film resist to form an endurance sandblast layer, etching a portion of the transparent substrate, which is not covered with the endurance sandblast layer, through a sandblast process, and removing the endurance sandblast layer from the transparent substrate.

According to still yet another aspect, the present invention provides a method for fabricating a plasma display, including the steps of forming a resist on a portion of a transparent substrate, on which a one-end portion of each of a plurality of partitions will be formed, a thickness of the resist being varied in a longitudinal direction of the partition; etching the transparent substrate using the resist as a mask; and forming the partitions on the transparent substrate, a height of the one-end portion of each of the partitions being varied in the longitudinal direction.

Preferably, lengths of thin portions of the resist are increased in the longitudinal direction, and widths of thick portions of the resist is gradually reduced in the longitudinal direction.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
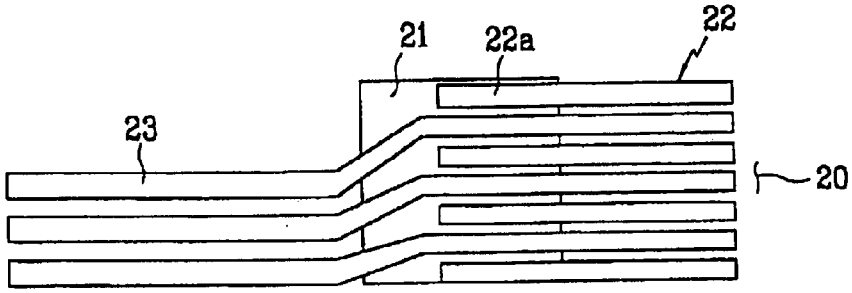
FIG. 1 is a plan view of a major portion of a plasma display according to a first embodiment of the present invention.
Figure 2:
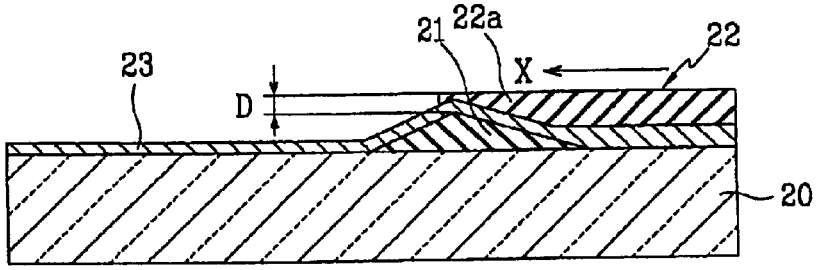
FIG. 2 is a sectional view of FIG. 1.

Turning now to the drawings, FIGS. 1 and 2 show a plasma display according to a first preferred embodiment of the present invention. As other parts that are not depicted in the drawings are identical to those of the earlier art, the detailed description thereof will be omitted herein.

In the drawings, the reference numeral 20 indicates one of two glass substrates, and the reference numeral 21 denotes a rectangular stepped buffering layer.

Line-shaped partitions 22 are formed on the buffering layer 21, and address line electrodes 23 are formed between the partitions 22 over the stepped buffering layer 21. Only a one-end portion 22*a* of each partition is formed on the stepped buffering layer 21.

Due to the stepped buffering layer 21 between the address electrode 23 and the glass substrate 20, the height D from the bottom to the top of the end portion 22*a* of the partition 22 is reduced, and the thickness of the address line electrode 23 becomes uniform in the vicinity of the end portion 22*a* of the partition 22.

Accordingly, the thickness of the address line electrode 23 becomes uniform, and the planar accuracy of the address line electrode is improved, thereby increasing the reliability of the address line electrode by preventing the address line electrode 23 from being short-circuited.

A method for fabricating the above described plasma display according to the first embodiment will be described hereinafter.

First, a dry film resist (DFR) having an endurance sandblast property is patterned to form the pattern of the partitions 22. In this embodiment, ORDYL BF405 produced by Tokyo Ohka Kogyo Co., Ltd. is used for the dry film resist.

The DFR pattern is attached on the glass substrate 20 using a laminator. The DFR pattern is exposed to light (300 $mJ/cm^2$) and developed by $Na_2CO_3$ 0.3% solution to form the endurance sandblast layer.

Next, an abradant is sprayed on the glass substrate 20 by a sandblast apparatus (manufactured by Fuji Manufacturing Co., Ltd.), thereby etching a portion of the glass substrate, which is not covered by the endurance sandblast layer. At this point, the depth of the etched groove becomes the height of the partition. In this embodiment, the depth of the etched groove is about 150 $\mu$m. Next, the glass substrate 20 is dipped into BF removal solution (produced by Tokyo Ohka Kogyo Co., Ltd.) so as to remove the remaining DFR.

Next, the stepped buffering layer 21 is formed on a portion, where the end portion 22*a* of the partition 22 will be formed, of the glass substrate 20.

In this embodiment, the stepped buffering layer 21 is formed of dielectric paste (produced by Sumitomo Metal Mining Co., Ltd.) through a screen-printing process. At this point, the thickness of the printed dielectric paste is about half of the height of the partition. After the printing process, as shown in FIG. 2, the end portion 22*a* of the partition 22 is designed to increase in its thickness as it goes in the longitudinal direction X of the electrode 23 and the partition 22 through a leveling process.

After the above, the glass substrate 20 is dried at a temperature of about 150° C. for 10 minutes, and baked at a temperature of about 550° C. for 10 minutes, thereby forming the stepped buffering layer 21 on the glass substrate 20.

Next, the address line electrodes 23 are formed between the partitions 22. As the electrode material, FODEL Ag paste (produced by Dupont) is used. That is, Ag paste is formed on the electrode forming area on the glass substrate 20 is formed through a screen-printing process. At this point, the thickness of the printed Ag paste is adjusted to be about 5–10 μm. Instead of the Ag paste, Ag—Pd paste may be used.

After the above, the printed Ag paste is dried at a temperature of about 150° C. for 10 minutes, and then exposed to light (400 mJ/cm$^2$) and developed by $Na_2CO_3$ 0.3% solution.

At this point, since there is the stepped buffering layer 21 in the vicinity of the end portion 22*a* of the partition 22, the thickness of the Ag paste is not increased in the vicinity of the end portion 22*a*. As a result, the margin is increased in the developing process, thereby making it possible to form the accurate electrode pattern. The Ag paste is baked at a temperature of about 550° C. for 10 minutes to form the address line electrodes 23.

Next, the address line electrodes 23 are covered with a high reflective dielectric layer (not shown), and red R, green G and blue B phosphors (not shown) are formed in each discharge cell defined by the partitions 22 and the dielectric layer. Finally, the glass substrate 20 and the other glass substrate (not shown) are sealed after the mixture gas such as Ne—Xe and He—Xe is injected into each discharge cell.

As described above, since the stepped buffering layer 21 is formed between the end portion 22*a* of the partition 22, the address line electrode 23 and the glass substrate 20, the distance from the bottom to the top of the end portion 22*a* of the partition 22 is reduced, thereby making it possible to uniformly form the thickness of the address line electrode and to precisely form the surface of the address line electrode. Accordingly, there is no possibility of short-circuit of the address line electrodes 23, thereby improving the reliability of the plasma display.

In addition, in the method of the plasma display according to the present invention, since the stepped buffering layer 21 is formed on a portion, where the end portion 22*a* of the partition 22 will be formed, of the glass substrate 20 after a portion, which is not covered by the endurance sandblast layer, of the glass substrate, the thickness of the address electrode paste is not increased in the vicinity of the end portion 22*a* of the partition 22. Accordingly, there is no possibility of short-circuit of the address line electrodes 23, thereby improving the reliability of the plasma display.

Figure 3:
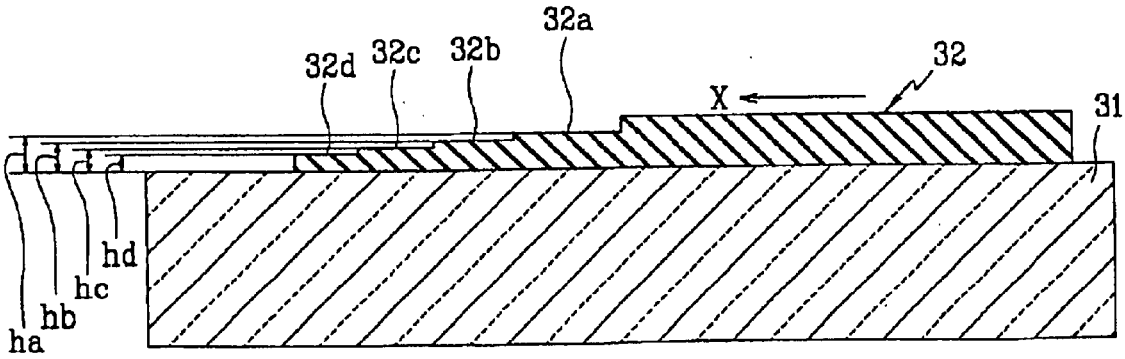
FIG. 3 is a sectional view of a major portion of a plasma display according to a second embodiment of the present invention.
Figure 4:
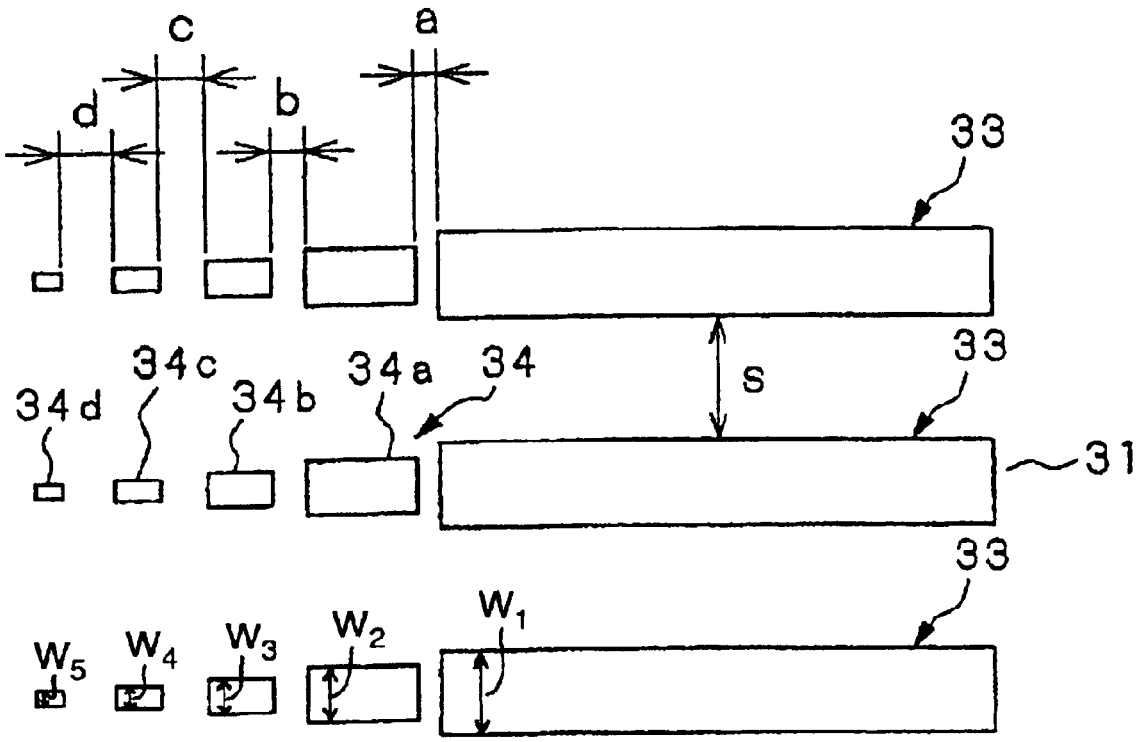
FIG. 4 is a plan view for illustrating a fabricating process of a plasma display depicted in FIG. 3.
Figure 5:
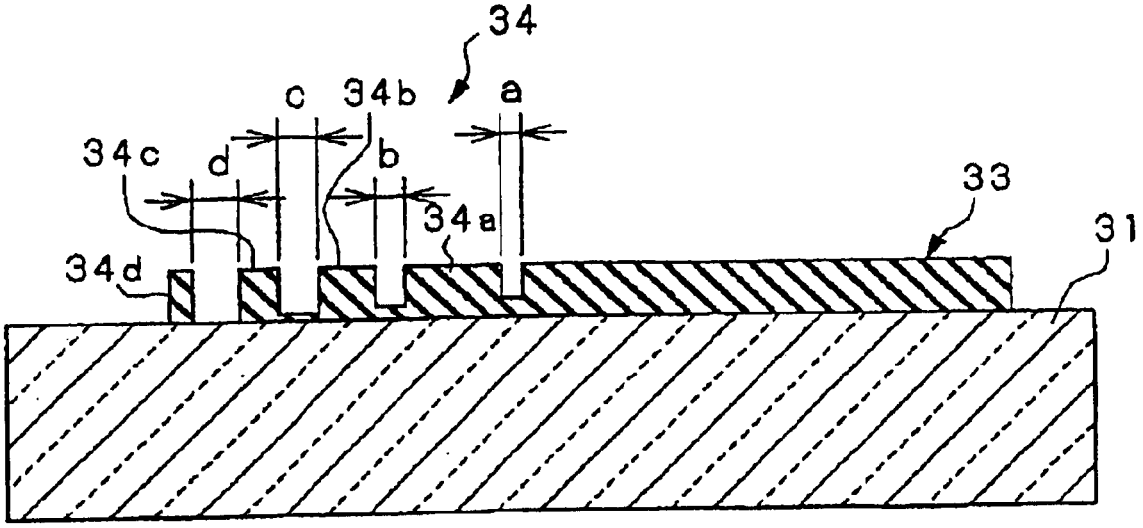
FIG. 5 is a sectional view for illustrating a fabricating process of a plasma display depicted in FIG. 3
Figure 6:
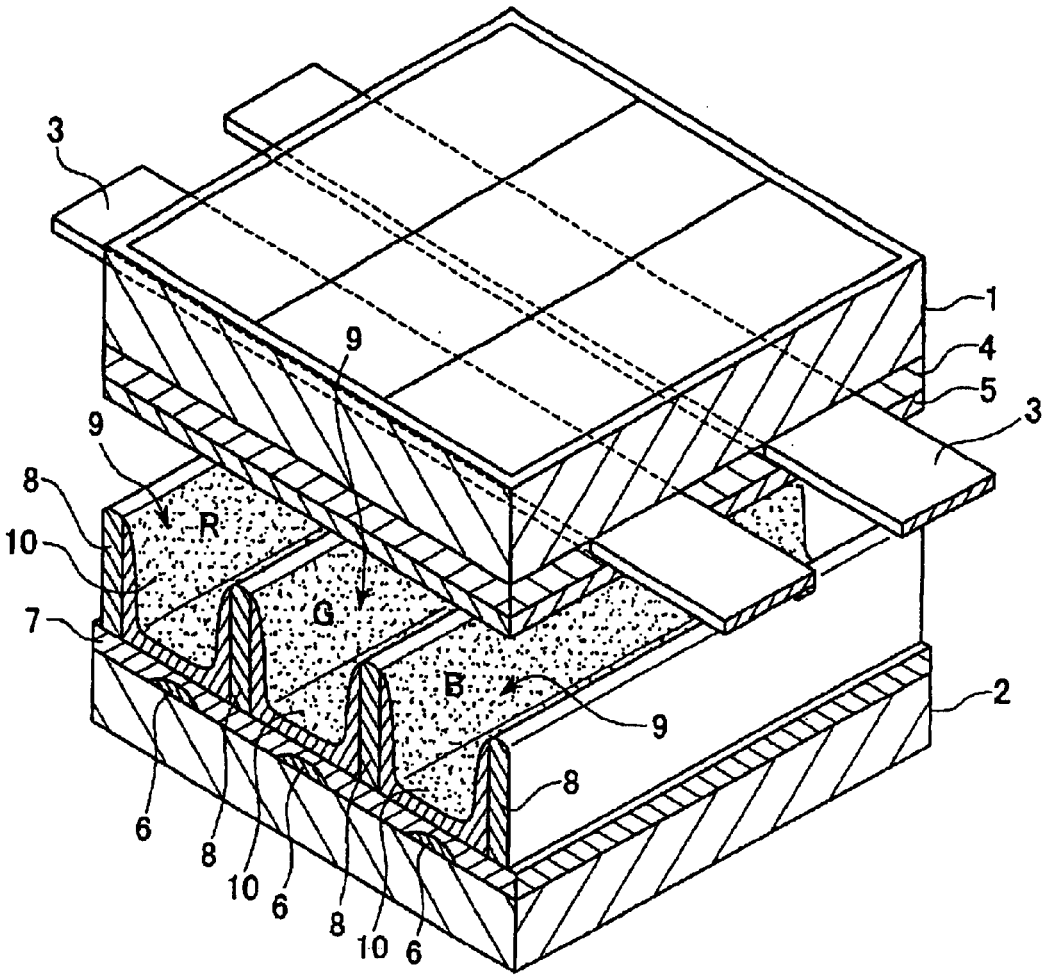
FIG.6 (Prior Art)
FIG. 6 is an exploded perspective view of an earlier plasma display.
Figure 7:
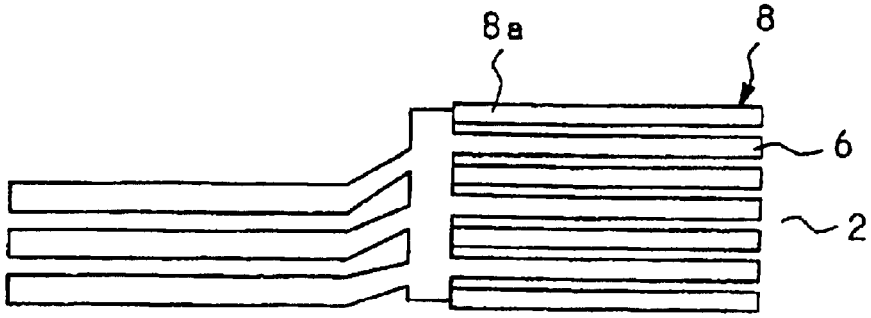
FIG.7 (Prior Art)
FIGS. 7 and 8 are respectively plane and sectional views for illustrating the problems of the earlier plasma display.
Figure 8:
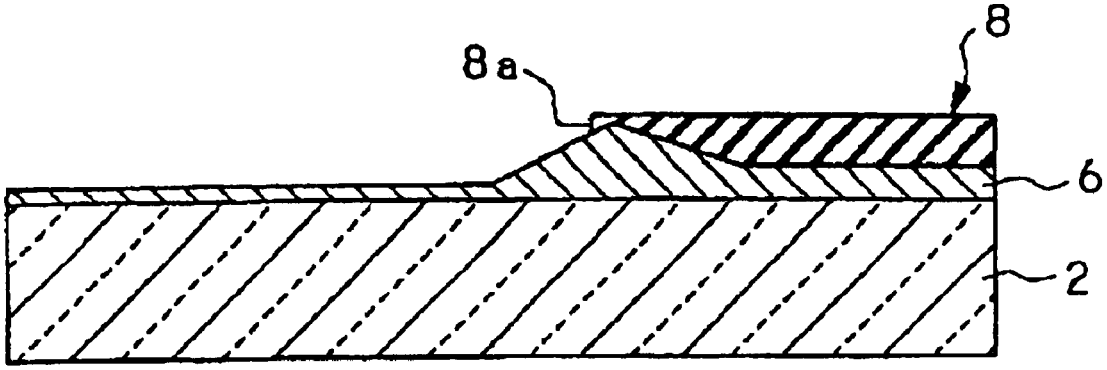
FIG.8 (Prior Art)

FIGS. 3 through 5 show a plasma display according to a second preferred embodiment of the present invention. In the drawing, the reference numeral 31 indicates one of two glass substrates, and the reference numeral 32 denotes partitions formed on the glass substrate 31. A one-end portion of the partition 32 is lowered as it goes to the proximal end in the longitudinal direction X'. That is, the end portion has first, second, third and fourth steps 32*a*, 32*b*, 32*c* and 32*d* that are lowered as they go to the proximal end in the longitudinal direction X'. The heights of the steps 32*a*, 32*b*, 32*c* and 32*d* are set to satisfy the following condition such that the height differences between the adjacent steps are reduced along the longitudinal axis, $$ha>hb>hc>hd$$

As described above, since the end portion of the partition 22 is decreasingly stepped, the thickness of the electrode paste is not increased in the vicinity of the steps 32*a*, 32*b*, 32*c* and 32*d*, thereby making it possible to uniformly form the thickness of the address line electrode and to precisely form the surface of the address line electrode. Accordingly, there is no possibility of short-circuit of the address line electrodes, thereby improving the reliability of the plasma display.

A method for fabricating the above described plasma display according to the second embodiment will be described hereinafter.

First, a dry film resist (DFR) having an endurance sandblast property is patterned on a portion, where the steps 32*a*, 32*b*, 32*c* and 32*d* will be formed, of the glass substrate 31 at the outer side of the partition pattern 33 formed of DFR to form the end portion patterns 34.

In this embodiment, although the end portion pattern is divided into 4 end portion patterns 34*a*, 34*b*, 34*c* and 34*d* in response to the 4 steps 32*a*, 32*b*, 32*c* and 32*d*, it may be divided into tens of the end portion patterns.

The first end portion pattern 34*a* is formed at a distance "a" from the partition pattern 33, the second end portion pattern 34*b* is formed at a distance "b" from the first end portion pattern 34*a*, the third end portion pattern 34*c* is formed at a distance "c" from the second end portion pattern 34*b*, and the fourth end portion pattern 34*d* is formed at a distance "d" from the third end portion pattern 34*c*.

The distances "a," "b," "c" and "d" are set to satisfy the following condition.

$$a<b<c<d$$

That is, the distances "a," "b," "c" and "d" are increased as they go to the end. In addition, the distances "a," "b," "c" and "d" are set to be narrower than the distance "s" between the partitions 33 so that the developing solution can be remained even under the development condition where the partition pattern 33 can be sufficiently formed. For example, when the width of the partition pattern 33 is 80 μm, and the distance "s" between the partition patterns 33 is 280 μm, the distances "a," "b," "c" and "d" are respectively set to be 30 μm, 50 μm, 70 μm, and 90 μm.

In addition, the widths of the partition pattern 33 and the end portion patterns 34*a*, 34*b*, 34*c* and 34*d* are set to satisfy the following condition.

The partition pattern (width $w_1$)>the first end portion pattern 34*a* (width $w_2$)>the second end portion pattern 34*b* (width $w_3$)>the third end portion pattern 34*c* (width $w_4$)>the fourth end portion pattern 34*d* (width $w_5$).

$$w_1>w_2>w_3>w_4>w_5$$

Now, the reason why the end portion pattern 34 is divided into a plurality of end portion patterns 34*a*, 34*b*, 34*c* and 34*d* will be described hereinafter.

Since the height difference between the end portion of the partition 32 and the surface of the glass substrate 31 is 150 μm, the thickness of the electrode paste (address line electrode 6) is increased. To avoid this, it is preferable that the height of the end portion of the partition is gradually reduced. Accordingly, the endurance sandblast resist pattern is formed considering this point.

To gradually reduce the height of the end portion of the partition 32, the end portion pattern 34 is formed such that its thickness is gradually reduced. As a result, the portion to be the partition 32 is not completely etched, the thin end portion pattern 34 will be completely etched and even the portion of the glass substrate 31 under the thin end portion pattern is etched. That is, the etching time is varied at the thick partition pattern 33 and the thin end portion pattern 34, the etching ratio of the glass substrate 31 is varied by the etching time difference. That is, the height of the partition 32 can be varied.

However, it is not easy to vary the thickness of the partition pattern and the process is not stable. Accordingly, in this embodiment, the partition pattern is formed as shown in FIGS. 4 and 5 so that the partition pattern can be gradually removed by the sandblast process.

In this embodiment, when the sandblast process used in the first embodiment is applied to the glass substrate 31 on which the partition pattern 33 and the plurality of end portion pattern 34*a*, 34*b*, 34*c* and 34*d*, the thin end portion pattern range "d" is first removed to specially form the fourth end portion pattern 34*d*. At this point, since the close contact area of the fourth end portion pattern 34*d* is reduced, the fourth end portion pattern 34*d* is immediately removed. Accordingly, a portion of the glass substrate under the fourth end portion pattern 34*d* and the range "d" portion are etched when the fourth end portion pattern 34*d* is removed.

Likewise, when the range "c" portion is removed, a portion of the glass substrate under the third end portion pattern 34*c* and the range "c" portion is etched, and when the range "b" portion is removed, a portion of the glass substrate under the second end portion pattern 34*b* and the range "b" portion is etched. In addition, when the range "a" portion is removed, a portion of the glass substrate under the first end portion pattern 34*a* and the range "a" portion is etched. By this process, the partition patterns are removed.

Accordingly, it becomes possible to provide the etching time difference in the vicinity of the end portion, allowing the height of the partition 32 to be varied in the longitudinal direction. When the electrode paste is printed on the glass substrate 31 provided with such partitions 32, the thickness of the electrode paste becomes uniform.

As described above, since the end portion of the partition 32 is decreasingly stepped, the thickness of the electrode paste is not increased in the vicinity of the steps 32*a*, 32*b*, 32*c* and 32*d*, thereby making it possible to uniformly form the thickness of the address line electrode and to precisely form the surface of the address line electrode. Accordingly, there is no possibility of short-circuit of the address line electrodes, thereby improving the reliability of the plasma display.

In addition, the four divided end portion patterns 34*a*, 34*b*, 34*c* and 34*d* on a portion of the glass substrate, where the steps 32*a*, 32*b*, 32*c* and 32*d* will be formed, and the glass substrate 31 is etched using the partition pattern 33 and the end portion patterns 34*a*, 34*b*, 34*c* and 34*d* as a mask. Accordingly, it can be prevented that the thickness of the electrode paste is increased, thereby obtaining the address line electrodes having the uniform thickness.

While this invention has been described in connection with what is presently considered to be the most practical and preferred embodiments, it is to be understood that the invention is not limited to the disclosed embodiments, but, on the contrary, is intended to cover various modifications and equivalent arrangements included within the spirit and scope of the appended claims.

For example, in the first embodiment, the stepped buffering layer 21 may be formed only between the end portion 22*a* and the glass substrate in a variety of shape.

In addition, in the second embodiment, although the end portion pattern 34 is divided into four block patterns, the number of block patterns is not limited to four. Furthermore, the shape of the block patterns may be varied and the widths of the end portion patterns may be identically formed.

What is claimed is:

1. A plasma display, comprising:

first and second transparent substrates disposed facing each other;

a plurality of partitions formed between the first and second transparent substrates;

a phosphor formed on inner surfaces of discharge cells defined by the partitions;

a stepped buffering layer formed on the first transparent substrate between one-end portions of the partitions; and a plurality of address electrodes formed on the first transparent substrate between the partitions and on the stepped buffering layer.

2. The plasma display of claim 1, further comprised of a thickness of the stepped buffering layer being gradually increased in a longitudinal direction of the partition.

3. The plasma display of claim 1, further comprised of the stepped buffering layer being formed on the first transparent substrate and being between the one-end portions of the partitions and the first substrate.

4. The plasma display of claim 3, with the partitions being line shaped partitions formed on the stepped buffering layer, and the address electrodes being formed between the partitions over the stepped buffering layer.

5. The plasma display of claim 4, with only the one-end portion of each partition being formed on the stepped buffering layer.

6. The plasma display of claim 5, with the stepped buffering layer being rectangular.

7. The plasma display of claim 5, with the stepped buffering layer being between the address electrode and the first transparent substrate, the height from the bottom to the top of the end portion of the partition being reduced, and the thickness of the address electrode being uniform around the end portion of the partition.

8. The plasma display of claim 7, with the stepped buffering layer being formed of dielectric paste through a screen-printing process.

9. The plasma display of claim 5, with the stepped buffering layer being formed between the one-end portion of the partition, the address electrode and the first transparent substrate.

10. The plasma display of claim 9, with the stepped buffering layer being formed only between the end portion and the first transparent substrate and the first transparent substrate being a glass substrate.

11. The plasma display of claim 9, with the end portion pattern being divided into a plurality of block patterns.

12. A plasma display, comprising:

first and second transparent substrates disposed facing each other;

a plurality of partitions formed between the first and second transparent substrates;

a phosphor formed on inner surfaces of discharge cells defined by the partitions; and a stepped buffering layer formed on the first transparent substrate between one-end portions of the partitions, wherein a height from the bottom to the top of a one-end portion of each of the partitions is gradually reduced in a longitudinal direction.

13. The plasma display of claim 3, with the one-end portion including a plurality of steps.

14. A plasma display, comprising:

first and second transparent substrates disposed facing each other;

a plurality of partitions formed between the first and second transparent substrates;

a phosphor formed on inner surfaces of discharge cells defined by the partitions; and a stepped buffering layer formed on the first transparent substrate between one-end portions of the partitions and the first transparent substrate, wherein a one-end portion of each of the partitions with regard to height from the bottom to the top of the partitions becomes thinner as it goes in a longitudinal direction corresponding to height of the stepped buffering layer.

15. A method for fabricating a plasma display, comprising the steps of:

forming grooves on a transparent substrate between partitions to be formed;

forming a stepped buffering layer on a portion of the groove corresponding to a one-end portion of each of the partitions; and forming a plurality of address electrode on the grooves as well as on the stepped buffering layer.

16. The method of claim 6, with the step of forming the grooves further comprising the steps of:

attaching a dry film resist having an endurance sandblast property on the transparent substrate;

exposing the dry film resist to light in a predetermined pattern and developing the dry film resist to form an endurance sandblast layer;

etching a portion of the transparent substrate, which is not covered with the endurance sandblast layer, through a sandblast process; and removing the endurance sandblast layer from the transparent substrate.

17. A method for fabricating a plasma display, comprising the steps of:

forming a resist on a portion of a transparent substrate, on which a one-end portion of each of plural partitions will be formed, a thickness of the resist being varied in a longitudinal direction of the partition;

etching the transparent substrate using the resist as a mask; and forming the partitions on the transparent substrate, a height of the one-end portion of each of the partitions being varied in the longitudinal direction.

18. The method of claim 17, with the resist further comprising thin portions, the lengths of thin portions of the resist being increased in the longitudinal direction.

19. The plasma display of claim 17, with the resist further comprising thick portions, the widths of thick portions of the resist being gradually reduced in the longitudinal direction.

20. The plasma display of claim 17, with the resist further comprising thick and thin portions, the widths of thick portions of the resist being gradually reduced in the longitudinal direction and the lengths of thin portions of the resist being increased in the longitudinal direction.

* * * * *